US010217370B2

(12) United States Patent
King

(10) Patent No.: US 10,217,370 B2
(45) Date of Patent: Feb. 26, 2019

(54) METHOD FOR EVALUATING FLIGHT PATHS AND FLIGHT PATH ENGINE

(71) Applicant: Alaska Airlines, Inc., Seattle, WA (US)

(72) Inventor: Matthew B. King, Coeur d'Alene, ID (US)

(73) Assignee: Alaska Airlines, Inc., Seattle, WA (US)

( * ) Notice: Subject to any disclaimer, the term of this patent is extended or adjusted under 35 U.S.C. 154(b) by 199 days.

(21) Appl. No.: 15/346,674

(22) Filed: Nov. 8, 2016

(65) Prior Publication Data

US 2018/0130362 A1 May 10, 2018

(51) Int. Cl.
*G08G 5/02* (2006.01)
*G08G 5/04* (2006.01)

(52) U.S. Cl.
CPC ..... *G08G 5/025* (2013.01); *G08G 5/045* (2013.01)

(58) Field of Classification Search
CPC ..... G08G 5/025; G08G 5/045
See application file for complete search history.

(56) References Cited

U.S. PATENT DOCUMENTS 7,302,318 B2 11/2007 Gerrity et al.
8,073,578 B1 * 12/2011 McCusker ..... G08G 5/0034 701/10
2006/0253232 A1 * 11/2006 Gerrity ..... G08G 5/0086 701/16
2015/0120100 A1 * 4/2015 Sacle ..... G01C 21/20 701/18
2016/0247406 A1 * 8/2016 Khatwa ..... G05D 1/0061
2018/0148192 A1 * 5/2018 Haskins ..... G08G 5/025

* cited by examiner

*Primary Examiner* — Brian P Sweeney
(74) *Attorney, Agent, or Firm* — Klarquist Sparkman, LLP

(57) ABSTRACT

A method of establishing a runway approach procedure for an aircraft at a selected runway, comprises, for obstacles in the final approach segment of the flightpath and having obstacle range values greater than the datum range, calculating a missed approach surface height at a projected intersection of a missed approach surface with a descending vertical error budget surface and a corresponding Distance to Height of Missed Approach Surface from the runway (DHMAS). For obstacles in the final approach segment and having obstacle range values less than the datum range, a missed approach surface height and a corresponding DHMAS are calculated using ascending climb gradient requirements. All DHMAS values are compared, and a controlling obstacle is determined as the obstacle having a greatest DHMAS. A decision altitude for the controlling obstacle is calculated, and the runway approach procedure is updated with the decision altitude. Relativistic metadata other obstacles can also be calculated and stored.

18 Claims, 23 Drawing Sheets

RF Turn Containment

Fly-by Turn Containment

300

(Google Earth Output from NAVGen)

FIG. 9
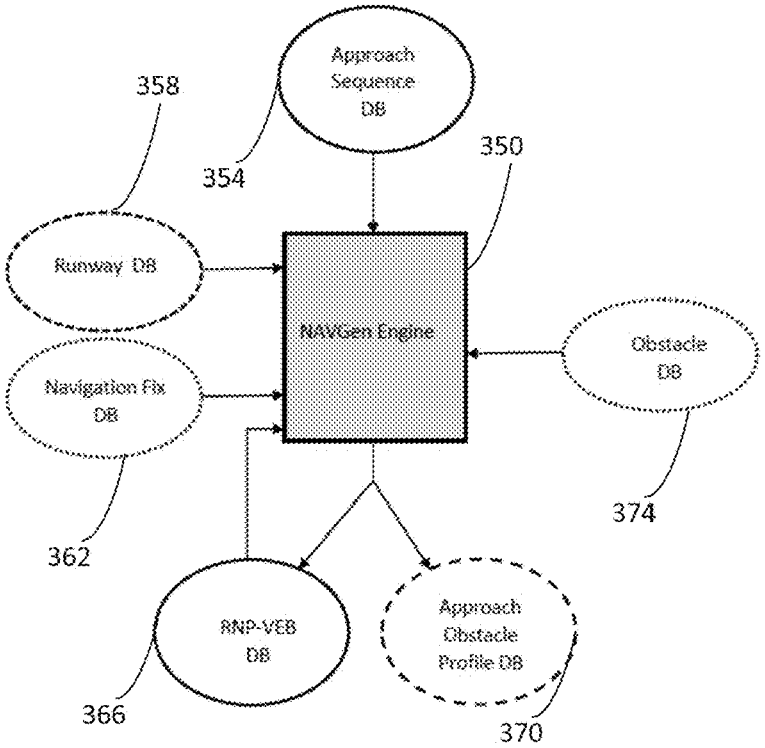
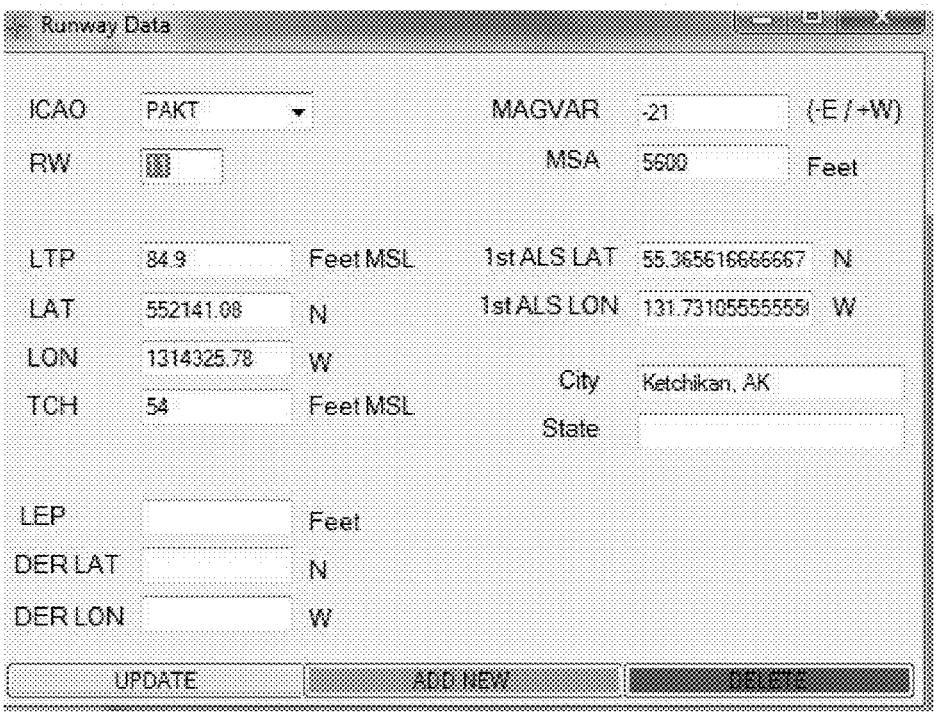
FIG. 10

300

BLDG
T-L TWR
T-L TWR
TREE
TREE
TREE

METHOD FOR EVALUATING FLIGHT PATHS AND FLIGHT PATH ENGINE

BACKGROUND

Developing a flight path for an aircraft using conventional tools and methods leads to limited options that sometimes result in less efficient routing of the aircraft and do not take full advantage of the capabilities of today's navigation systems.

For example, the TARGETS (Terminal Area Route Generation and Traffic Simulation) software tool offered by MITRE Corporation does not allow flight path engineers to include curved flight path segments within a final approach visual segment phase of a flight path being developed and/or evaluated. Curved segments are important, however, as they allow for flight paths to be made shorter and to avoid selected areas (such as, e.g., obstacles, noise abatement, traffic, etc.). Curved segments are one feature of RNP (Required Navigation Performance) approach procedures.

In addition, allowing for curved segments provides flight path engineers with more design options, particularly in scenarios where numerous obstacles must be negotiated. Current software tools and techniques to analyze and design flight paths in which numerous obstacles must be avoided to determine a final approach are limited. These current tools may not allow for analysis and detailed calculation of certain parameters, and thus not realize all of the possible benefits for aircraft having the latest navigation technology.

SUMMARY

Described below are implementations of methods and systems that address the drawback of conventional tools and methods.

According to one implementation, a method of establishing a runway approach procedure for an aircraft at a selected runway comprises receiving a three dimensional flightpath to the runway comprising multiple navigation data points and determining a minimum start of climb datum (subsequently referenced as datum) along the flightpath. The datum being is based on an altitude for a selected glide path angle for the aircraft and having a datum range defined as a distance from the datum to a runway. A lateral containment boundary is defined for the flightpath. For obstacles along the flightpath and within the lateral containment boundary, respective obstacle range values are assigned, wherein an obstacle range value for a selected obstacle is equal to an along-track distance of the selected obstacle from the runway.

For obstacles in the final approach segment of the flightpath and having obstacle range values greater than the datum range, a missed approach surface height is calculated at a projected intersection of a missed approach surface with a descending vertical error budget surface. A corresponding Distance to Height of Missed Approach Surface from the runway (DHMAS) is also calculated. For obstacles in a final approach segment of the flightpath and having obstacle range values less than the datum range, a missed approach surface height and a corresponding DHMAS is calculated using ascending climb gradient requirements.

To determine the controlling obstacle, the DHMAS values are compared and the obstacle having a greatest DHMAS is determined to be the controlling obstacle. A decision altitude is calculated for the controlling obstacle, and the runway approach procedure is updated with the decision altitude. In some embodiments, all obstacle calculations relative to the datum and the newly calculated controlling surfaces are stored as approach specific metadata objects to maintain a unique evaluation dataset.

A flight path engine with at least processor and a memory for carrying out instructions to implement related method acts is also described. Computer-readable media storing computer-executable instructions for causing a computing system programmed thereby to perform related methods are also described.

BRIEF DESCRIPTION OF DRAWINGS

FIG. 9 is a schematic diagram of a representative flight path engine showing various databases from which information used in generating a flight path is accessed and in which final flight path information is updated.

FIG. 10 is an illustration of a representative user interface providing runway information from a runway information database.

DETAILED DESCRIPTION

Figure 1:
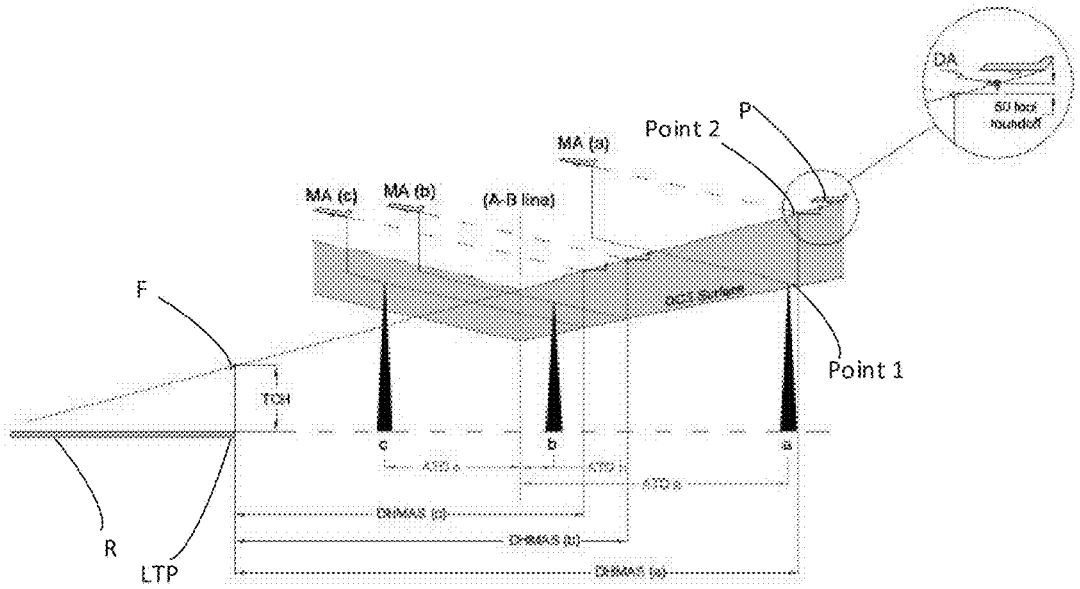
FIG. 1 is a schematic side elevation view of an aircraft's flight path toward a runway.

FIG. 1 is a schematic side elevation view of an aircraft P on a descent to a runway R along a flight path F. Within the aircraft's distance or range to the end of the runway, there are multiple obstacles, represented in FIG. 1 as obstacles a, b and c, that must be safely navigated. In the following description, a procedure for efficiently and rigorously determining a controlling obstacle from among the multiple obstacles is described. With the controlling obstacle defined, a resultant runway approach procedure can be determined.

In some implementations, a datum for the desired flight path or approach procedure is calculated based on (1) a selected minimum decision altitude and (2) a selected glide path angle. The minimum decision altitude is defined as the altitude at which a Missed Approach procedure must be initiated if the required visual reference to continue the current approach has not been established. A Missed Approach procedure is a set of steps followed by a pilot when an instrument approach cannot be completed to a full-stop landing. The minimum decision altitude is typically defined according to the selected aircraft's type, and more specifically, the type of navigation technology with which the selected aircraft is equipped. For example, if the aircraft is equipped with WAAS technology, then the minimum decision altitude for the aircraft may be set even lower. (WAAS criteria minimums may be decreased to as low 150 ft. or even lower in the future).

The second factor, i.e., the selected glidepath angle (GPA), is specific to the selected approach and typically is in the range from approximately 2.7 to 3.6 degrees for a passenger aircraft.

As indicated in the example of FIG. 1, the datum has been determined to be located as indicated by the A-B line at the datum. The distance from the datum to the runway, and more specifically, the along track distance (ATD) from the A-B line to the landing threshold point (LTP), is given as $ATD_{ABLTP}$. The Threshold Crossing Height (TCH) is the height above the runway (and more precisely, the height above the LTP) at which the computed glidepath crosses the threshold. Thus, the distance $ATD_{ABLTP}$ can be calculated as $ATD_{ABLTP}$=(200 ft−TCH)/tan(GPA). The minimum decision altitude defined by RNP or Barometric-type criteria is 250 ft., and the round-off allowance for aircraft inertia and/or pilot error is 50 ft. Therefore, 200 ft. is defined as the minimum descent altitude (250 ft.-50 ft.=200 ft.).

Referring again to FIG. 1, for each obstacle, a distance from the obstacle to the datum is defined. Thus, the obstacle c is downrange from the A-B line by the distance $ATD_c$. Similarly, the obstacles b and a are uprange from the A-B line by the distances $ATD_b$ and $ATD_a$, respectively.

As also shown in FIG. 1, two imaginary surfaces can be shown to assist in illustrating additional calculation steps. The lower descending surface in FIG. 1 is referred to as an Obstacle Clearance Surface (OCS). For preliminary explanatory purposes, the OCS as illustrated in FIG. 1 is shown as a planar surface (as described below, a curved surface is used for actual calculations to ensure required accuracy). The lower ascending surface is a Missed Approach Surface (MAS).

In the example of FIG. 1, two of the three obstacles, i.e., obstacles a and b, penetrate the OCS. Obstacle b penetrates the OCS by greater distances than obstacle a, but, as the calculations shown below reveal, obstacle a becomes the controlling obstacle in the example. A missed approach surface slope ($MA_{OCSslope}$) is calculated for each obstacle, i.e., a hypothetical surface of constant slope defined to intersect the top of the obstacle (and rest upon it), and is extended uprange until it intersects the OCS. Point 1 is the point at which the $MA_{OCSslope}$ line for obstacle a intersects the OCS. Point 2 is defined to be vertically above Point 1, and at the intersection of the MAS at the same ATD as for Point 1. Thus, Point 2 is defined as the Distance to Height of Missed Approach Surface for obstacle a, or DHMAS(a). Similarly, the corresponding values of DHMAS(b) for obstacle b and DHMAS(c) for obstacle c are shown. In the example, it is determined that DHMAS(a) is greater in magnitude than DHMAS(b) or DHMAS(c), and on that basis, obstacle a is determined to be the controlling obstacle for subsequent calculations. That is, after the required calculations are performed for obstacle a, it is determined that obstacle a yields a higher decision altitude (DA) than for obstacle b. Obstacle c, downrange from the AB line, penetrates the MAS and raises the decision altitude, but the resultant value of DHMAS(c) does not have a greater magnitude than the DHMAS(a) value of the controlling obstacle a.

The DA range for obstacle a is shown as a point on the MAS. By convention, and as shown in the magnified circle, DA is defined at a point on the MAS vertically above at Point 2 (and shown offset in the uprange direction) by a selected roundoff margin (e.g., 50 ft.).

Figure 3A:
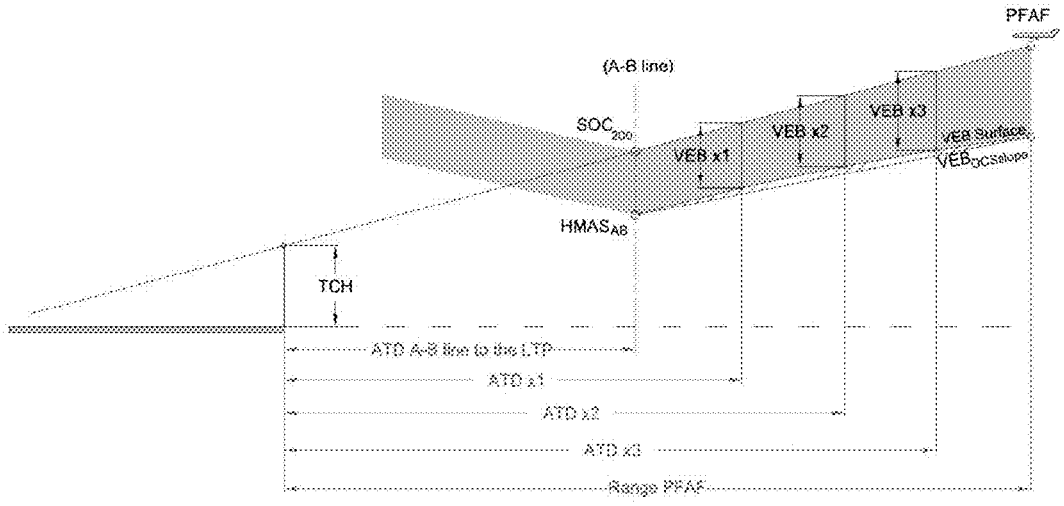
FIGS. 3A, 3B and 4 are additional schematic side elevation views of an aircraft on a flight path toward a runaway.

In fact, and as alluded to above, the surface against which obstacle penetration is evaluated can be curved as well as planar (Barometric-type calculation is curved/WAAS calculation is planar). Referring to FIG. 3A, a curved surface, called a Vertical Error Budget (VEB) Surface, is shown in relation to the constant slope OCS, which is referred to in FIG. 3A as $VEB_{OCSSlope}$. The VEB slope can be derived from the VEB curvature tangent any specific point. The VEB Surface intersects the datum (A-B line) at a point defined as $HMAS_{AB}$. As shown in FIG. 3A, for three hypothetical obstacles x1, x2 and x3 at different distances uprange from the datum, the corresponding vertical error budgets (VEB x1, VEB x2 and VEB x3) can be calculated at the corresponding intersections with the curved VEB Surface below the projected aircraft altitude. This upper surface in FIG. 3A is defined at the datum at an aircraft altitude of 200 ft. above the threshold point elevation, which is called the $SOC_{200}$ (Start of Climb) point, and extending uprange from the $SOC_{200}$ point to a Precision Final Approach Fix (PFAF). The Threshold Crossing Height (TCH) is the height above the runway (and more precisely, the height above the LTP) at which the computed glidepath crosses the threshold. Thus, the following equations can be given in conjunction with FIG. 3A:

$$ATD_{ABLTP}=(200\text{ ft.}-TCH)/\tan(GPA)$$

$$HMAS_{AB}=200\text{ ft.}-(VEB\text{ at }ATD_{ABLTP})+LTP_{elev}$$

$$SOC_{200}=ATD_{ABLTP}\times\tan(GPA)+LTP_{elev}+TCH$$

Figure 3B:
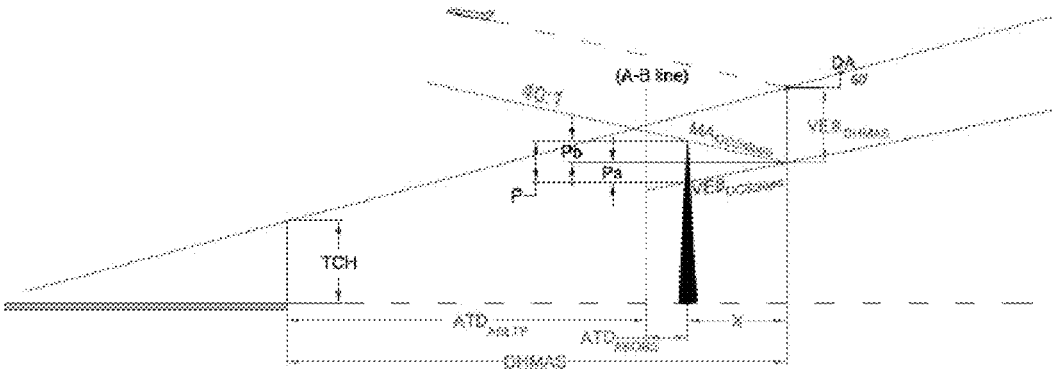

In FIG. 3B, further details of the calculation of DHMAS for an obstacle uprange of the datum are shown. For all obstacles penetrating the $VEB_{OCSSlope}$ uprange of the A-B line, DHMAS is calculated using the $VEB_{OCS}$ and resting $MAS_{OCSSlope}$ ratios. For example, the $VEB_{OCSSlope}$ can be defined as a ratio range of approximately 18-22:1, and the $MAS_{OCSSlope}$ can be defined as 40:1 at a minimal climb gradient. Thus, the following equations can be given in connection with FIG. 3B for an example obstacle obs that penetrates the VEB surface by a distance P:

$$P=Pa+Pb \text{ where } Pa=X/\mathrm{VEB}_{OCS} \text{ and } Pb=X/\mathrm{MAS}_{OCSlope}$$

$$X=P\times(\mathrm{VEB}_{OCSSlope}+\mathrm{MAS}_{OCSSlope})$$

$$\mathrm{DHMAS}=X+\mathrm{ATD}_{ABobs}$$

As a result, DHMAS for obstacles more distant from the runway than the datum, i.e., with range values greater than the datum, is measured at the projected intersection of the missed approach surface with a descending vertical error budget surface.

Figure 4:
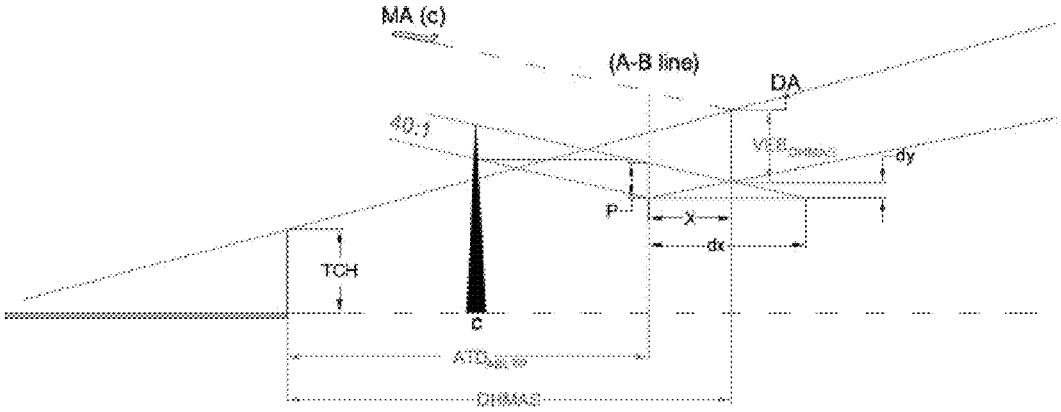

In FIG. 4, further details of the calculation of DHMAS for an obstacle downrange of the datum, such as obstacle c, are shown. For each obstacle downrange of the datum, penetrations of the 40:1 $\mathrm{MAS}_{OCSSlope}$ line are evaluated to calculate DHMAS by the intersection of the projected MAS and the VEB surface. For example, obstacle c is assumed to penetrate the MAS surface by P feet. Thus, the following equations can be given in connection with FIG. 4:

$$dx=P\times 40$$

$$dy=dx/(\mathrm{VEB}_{OCSSlope}+\mathrm{MAS}_{OCSSlope})$$

$$X=dy\times\mathrm{VEB}_{OCSSlope}$$

$$\mathrm{DHMAS}=\mathrm{ATD}_{ABLTP}+X$$

Therefore, for obstacles located between the datum and the runway, i.e., having range values less than the datum, DHMAS is calculated using climb gradient requirements. For example, in the case of some commercial aircraft, the current climb gradient is specified as 40:1, which is 151.9 ft./nautical mile based on single engine operation]

In some scenarios, it is desirable to develop and fly curved approach paths to negotiate with adverse terrain. Because of the turns executed by the aircraft flying these approach paths, the wings dip during banking maneuvers. As a result a body geometry term, the vertical air budget equation is variable to account for the varying body geometry of the aircraft as it executes turning segments as compared to straight segments. Therefore, the vertical air budget for an approach path that involves turns (i.e., it includes curved segments) differs from the vertical air budget defined for straight-in approaches using only linear vertical air budget calculations.

Figures 5A, 5B:
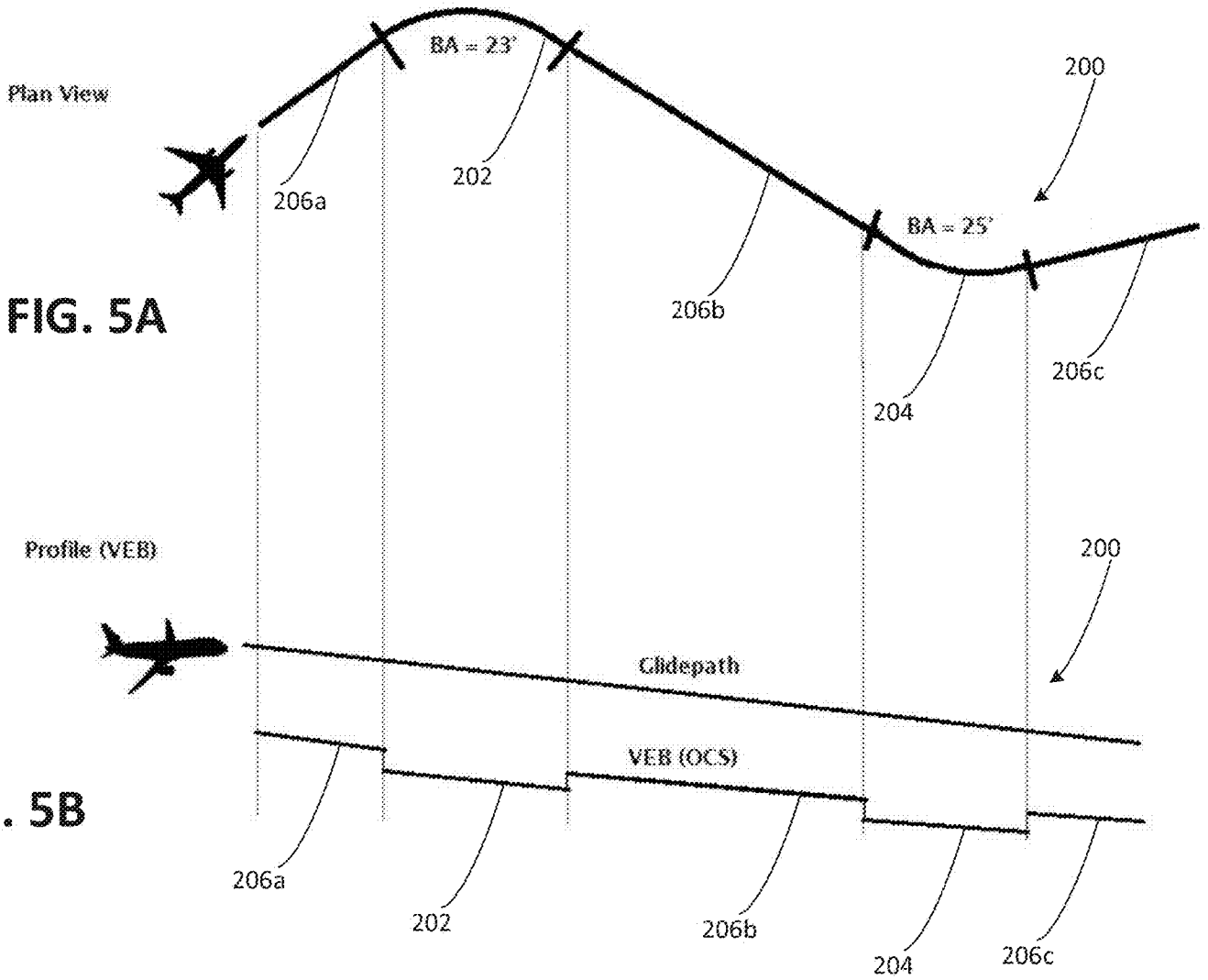
FIGS. 5A and 5B are schematic plan view and side elevation (profile) view illustrations of a flight path having curved segments.

Referring to FIG. 5A, a schematic plan view of a representative curved approach path 200 is shown. A corresponding side elevation view of the flight path 200 is shown in FIG. 5B. As indicated, the flight path 200 includes a first curved segment 202 and a second curved segment 204. The curved segments 202, 204 are interspersed among straight segments 206*a*, 206*b* and 206*c*. With reference to FIG. 5B, the vertical error budget must be greater for the curved segments 202 and 204 than for the straight segments 206*a*, 206*b*, 206*c* because one of the aircraft's wing tips dips to a lower altitude than the fuselage while the aircraft is turning through a curved segment. In the curved segment 202, the aircraft undergoes a bank angle of 23 degrees. In the curved segment 204, the aircraft undergoes a bank angle of 25 degrees.

Figure 5C:
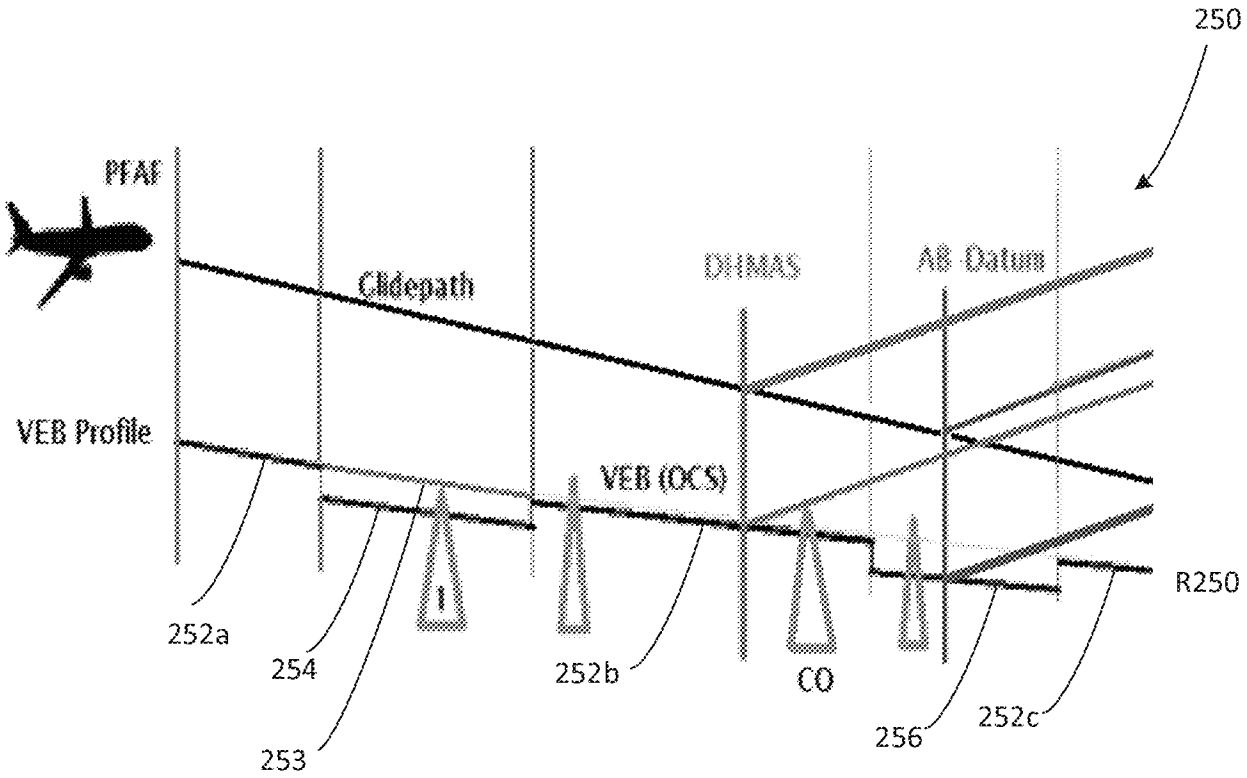
FIG. 5C is another schematic side elevation view of a flight path having curved segments.

FIG. 5C is one representative illustration of how the described techniques and tools lead to more accurate determination of safe flight paths. As shown in the representative flightpath 250, if the calculations are performed using only an average OCS slope between PFAF and R250 (as indicated by line 253), and not accounting for the VEB depression in turning segments 254, 256, then the penetration of obstacle 1 through the true obstacle clearance surface would not be revealed and could lead to an unsafe flight path (note that obstacle 1 penetrates the turning segment 254 but not the average OCS slope 253). Therefore, after the obstacle having the maximum DHMAS value is determined, i.e., the controlling obstacle CO, other obstacles having less range to the runway are calculated with the true vertical error budget correctly applied.

The VEB surface below the glidepath is not linear. As can be seen in FIG. 5C, there is a greater height difference between the glidepath and the VEB surface at PFAF than at points closer to the runway (such as at R250 at the right side of FIG. 5C). In the illustrated example, the magnitude of the VEB (i.e., the vertical depth) at DHMAS for the CO is greater than the VEB at the AB datum. Because DHMAS is moved aft (i.e., to the left in FIG. 5C) based on determining CO to be the controlling obstacle, the height at DHMAS is greater than at the AB datum, which is further forward (i.e., to the right in FIG. 5C).

In other examples, if there is a turn in the flightpath forward of the location of DHMAS for the controlling obstacle, then there could be a scenario where the VEB surface for this turn in the flightpath has a higher height than at the DHMAS location.

Figure 6:
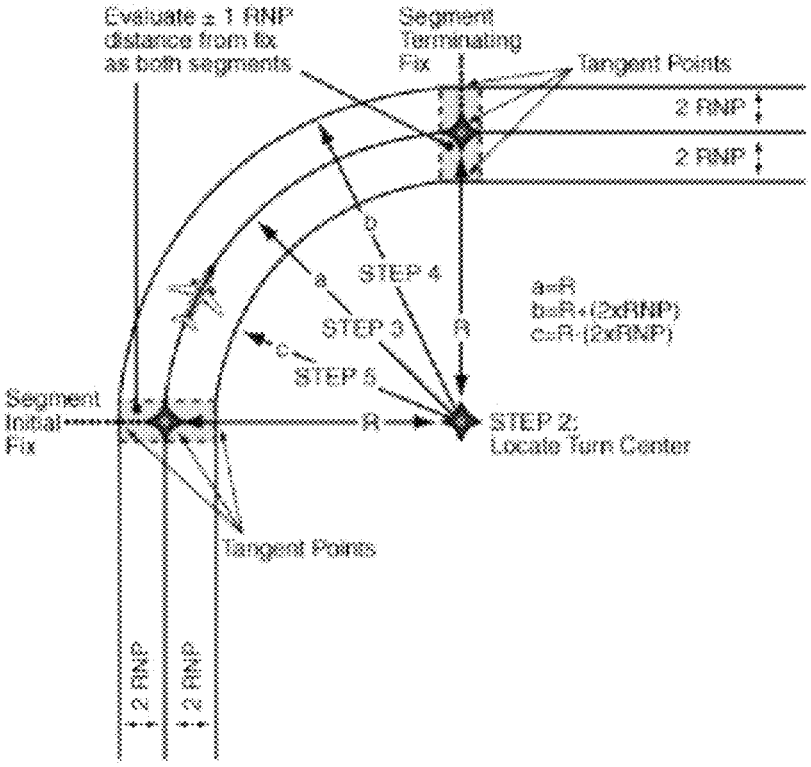
FIG. 6 is a schematic plan view diagram showing various parameters used in determining a radius-to-fix (RF) turn containment.
Figure 7:
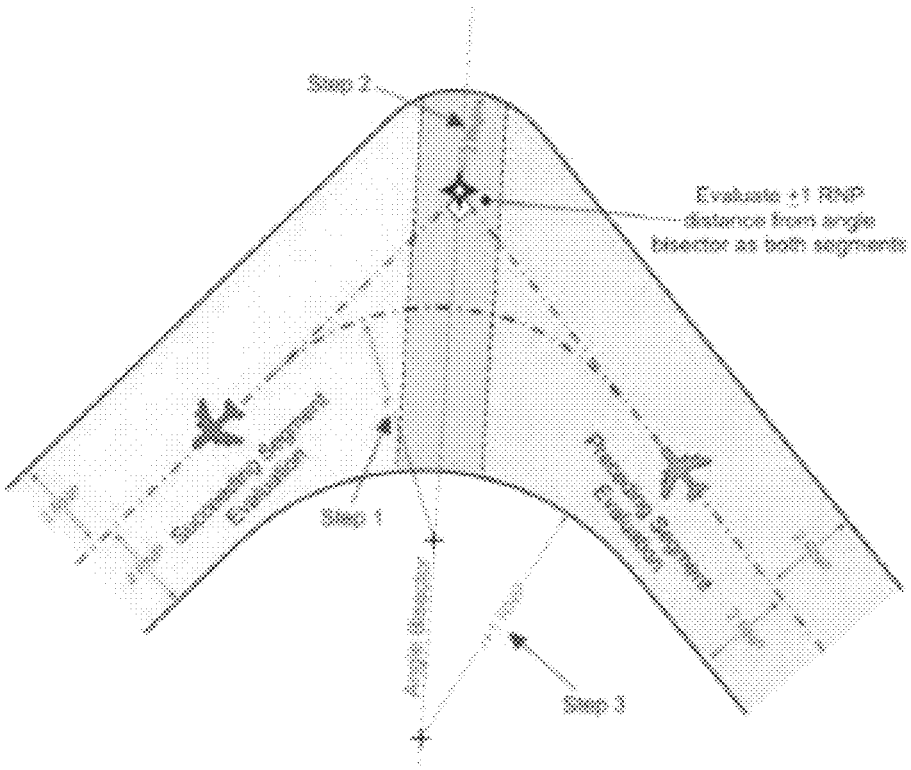
FIG. 7 is a schematic plan view diagram for a representative fly-by turn containment.

FIG. 6 is a plan view diagram illustrating a radius-to-fix (RF) turn containment, which is a constant radius turn around a fix. Obstacles are captured within the lateral containment of the flight path based on their lateral distance from the ground-track center line. Obstacles captured in RF turns are evaluated based on the lateral arcing containment around a radius fix. Obstacles near fly-by turns, such as is shown in the example of FIG. 7, are evaluated based on a more complex shaped inner and outer turn radius calculated by the aircraft turn performance parameters. Geodetic calculations such as range to the runway, and the lateral-track to the geodetic ground track center line, are stored as obstacle geodetic and profile metadata in the obstacle containment subset. Fly-by turn containment is a complex shape that is a function of the aircraft's speed, course change, and DTA. Several algorithms must be calculated to determine the turn radius center based on the left-right turn recognition, and the complex inner radius containment shape must capture all obstacles.

Figure 8:
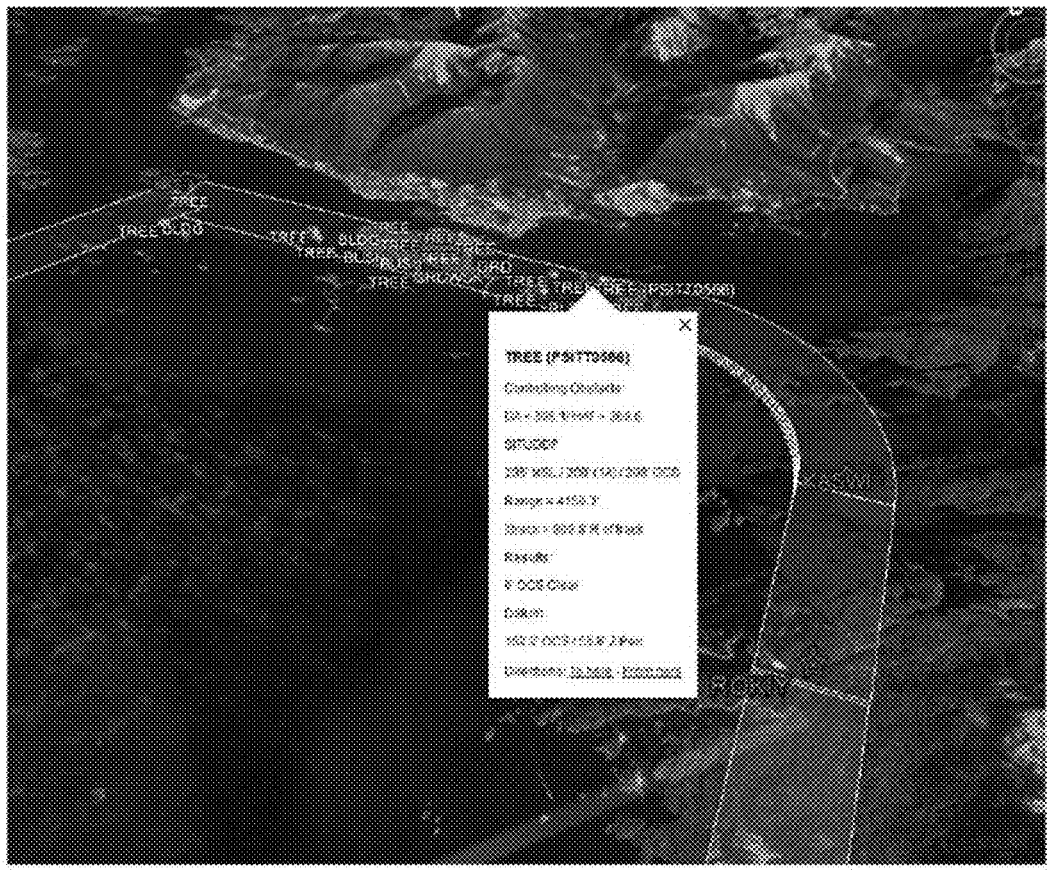
FIG. 8 is a graphic output from a flight path engine illustrating a flight path, together with obstacles within the flight path and a window of specific information for a selected obstacle of interest.
Figure 15:
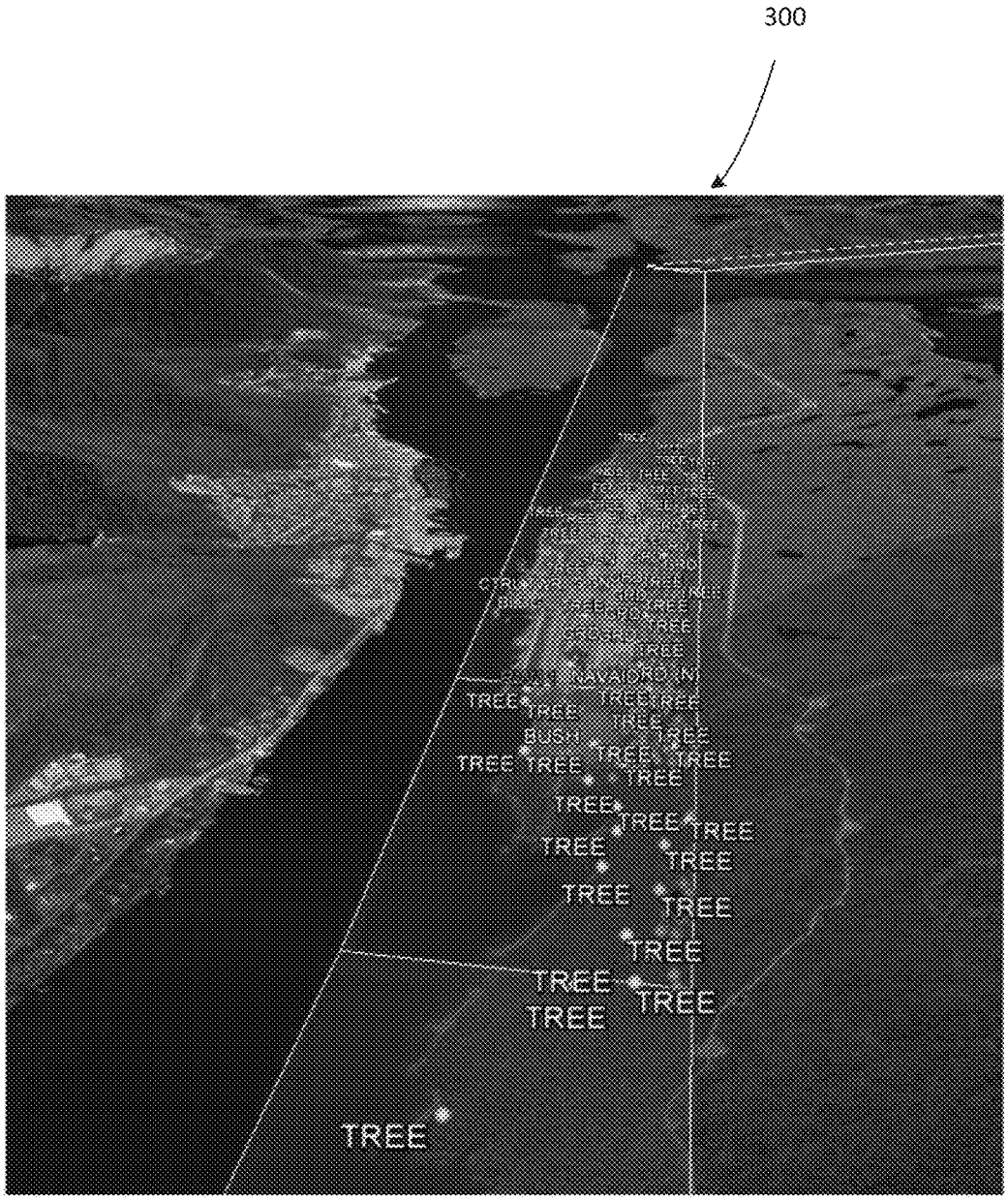
FIGS. 15 and 16 are representative views of segments of the flight path illustrated on aerial photos of the area at two different levels of magnification.
Figure 16:
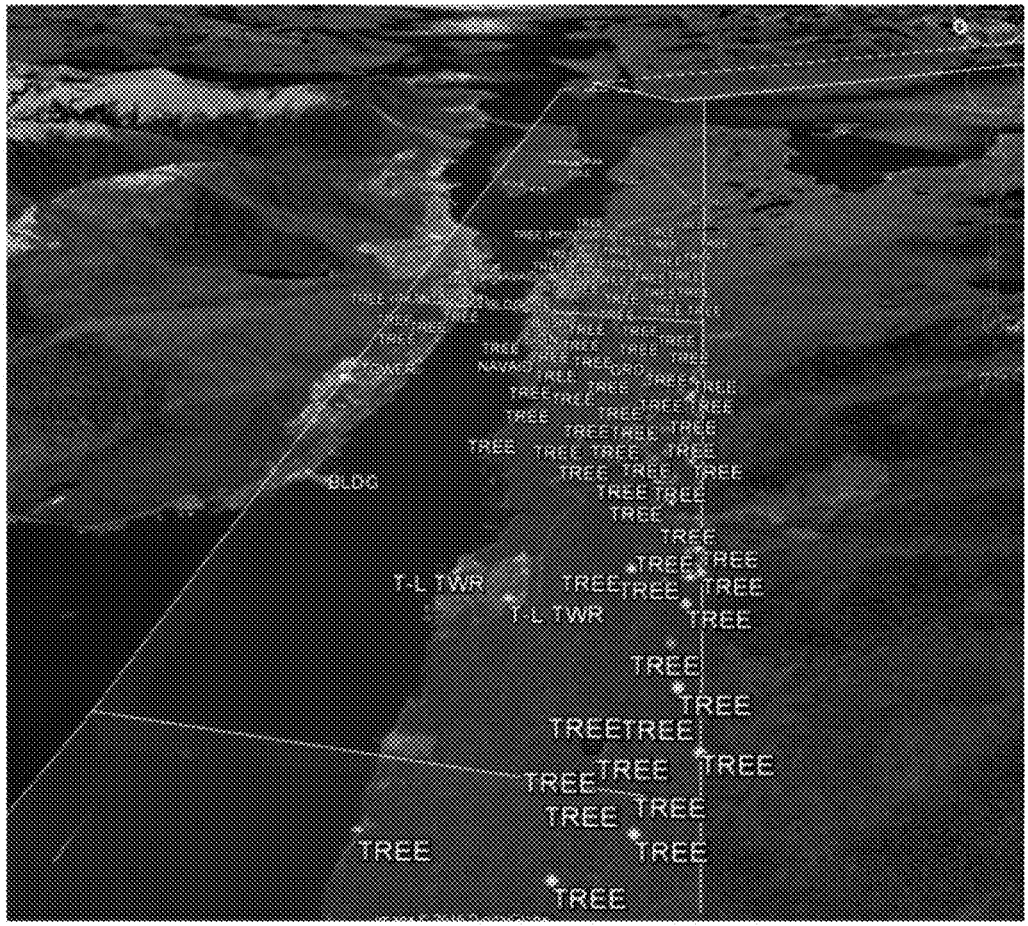

The system, referred to herein as the NAVGen engine, includes among its outputs a graphical representation of the flight path, such as is shown in FIG. 8. For example, a suitable NAVGen data object can be exported for use with GIS software platforms such as Google Earth or ESRI. In the representative flight path 300, the flight path's lateral boundaries are shown, as well as the sequence of straight and curved flight path segments. The flight path is also shown at greater magnification in FIGS. 15 and 16. Obstacles within the flight path appear as discrete points and include a description and an identification (e.g., "tree"). In addition, established locations such as ROKAY and KASWI, which are within the flight path, can also be shown. The operator can display more information for any point relative to the subject approach path, such as for the tree PSITT0566 as shown in FIG. 8. As can be seen from the pop-up window, the tree PSITT0566 is the controlling obstacle. The decision altitude, range, track and other information relevant to this obstacle are also shown.

FIG. 9 is a schematic diagram showing the relationship between the NAVGen engine, indicated at 350, and several databases with which the NAVGen engine 350 interacts during determination of a flight path. An approach sequence database 354 includes fix sequence, altitude constraint, segment performance and path determination descriptor information. A runway database 358 includes geodetic survey data and ICAO designation information. A navigation fix database 362 includes fix coordinate data, including both public data and in some cases, proprietary data. A RNP-VEB database 366 includes lateral containment parameter, VEB calculation and approach profile results information. An approach obstacle profile database 370 includes resultant metadata for obstacles contained within the selected RNP and approach sequence parameters information. An obstacle database 374 includes world-wide obstacle and terrain geodetic survey information. As indicated schematically, the NAVGen engine 350 uses information from various databases and generates updated information which is output to the RNP-VEB database 366 and the approach obstacle profile database 370.

Figure 12:
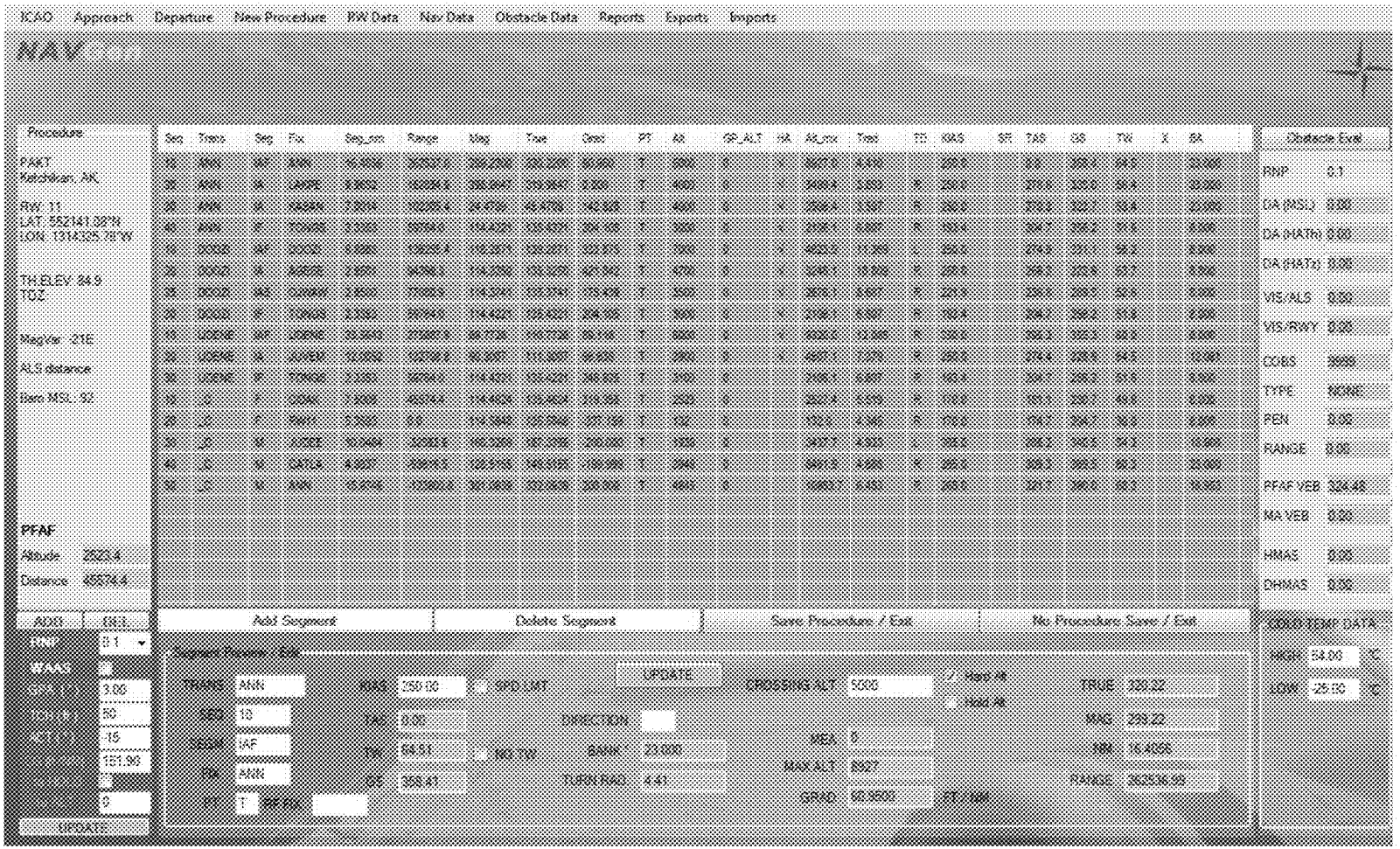
FIG. 12 is a representative user interface for the flight path engine showing multiple fix coordinates indexed in order and associated as a flight path, together with areas for flight path designer input and controlling obstacle output.

FIG. 12 is a representative user interface for the NAVGen engine 350 showing the details of a saved approach procedure for a particular runway, in this case, a runway in Ketchikan, Ak. An approach sequence table is generated as shown. Navigation fix points are automatically placed in sequence. Feeder transition segment designators allow the transitions to join the "common route" for the final approach sequence and then continue through the missed approach sequence. Segment distances and azimuths are calculated automatically. Aircraft parameters relating to altitude constraints, tailwind components, ground speed and bank angles are additional factors that are taken into consideration.

Each approach procedure (sequence file) has one or more RNP-VEB records linked by the associated ICAO key field with RNP values defining the lateral containment. The lateral containment expands the number of obstacles implicated by the NAVGen techniques and tool. User inputs include minimum temperature for Barometric procedures, glide path angle, and threshold crossing height. By executing an obstacle evaluation command, all vertical calculations are completed, and the procedure minimum results are stored. These results, as shown at the right in FIG. 12, can include the decision altitude prescribed by the controlling obstacle, the controlling obstacle penetration, the minimum visibility at the decision altitude, cold temperature calculations for barometric RNP, and the controlling obstacle record number.

Figure 11:
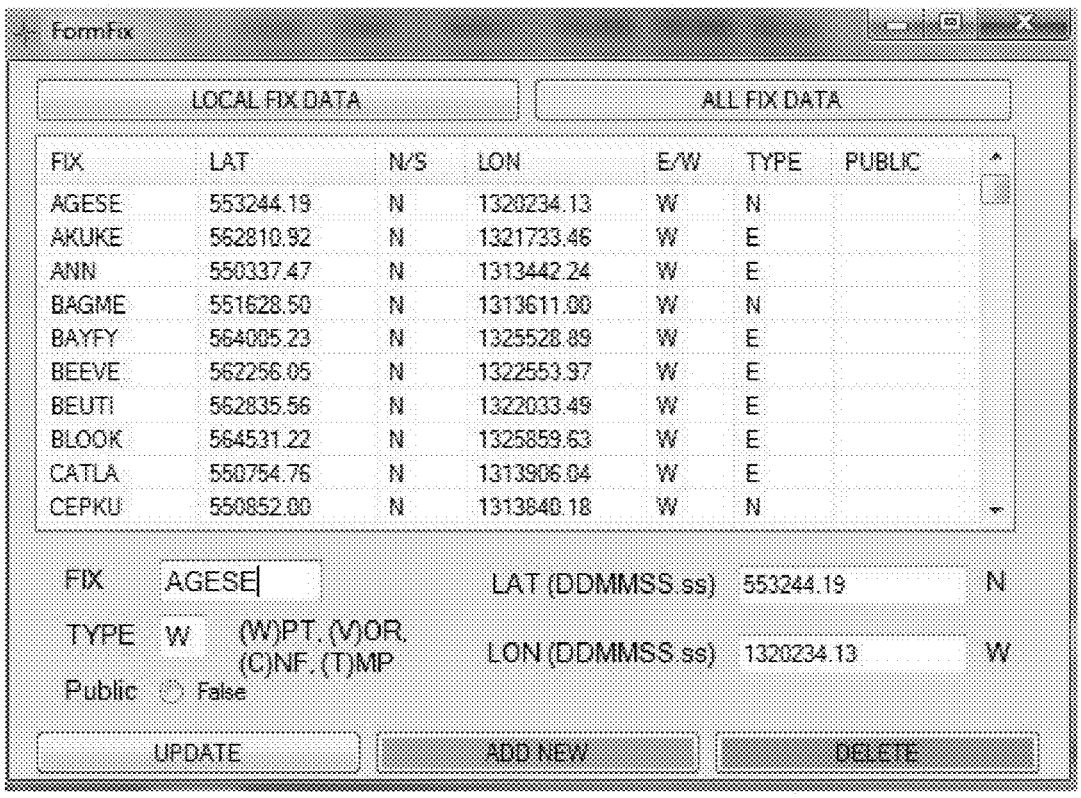
FIG. 11 is an illustration of a representative user interface providing fix coordinates for a selected flight path.

FIG. 10 is a user interface showing runway data for a selected airport (in this case, the PAKT airport in Ketchikan, Ak.) used by the NAVGen engine. FIG. 11 is a screen display of fix data related to a selected procedure used by the NAVGen engine.

Figure 13:
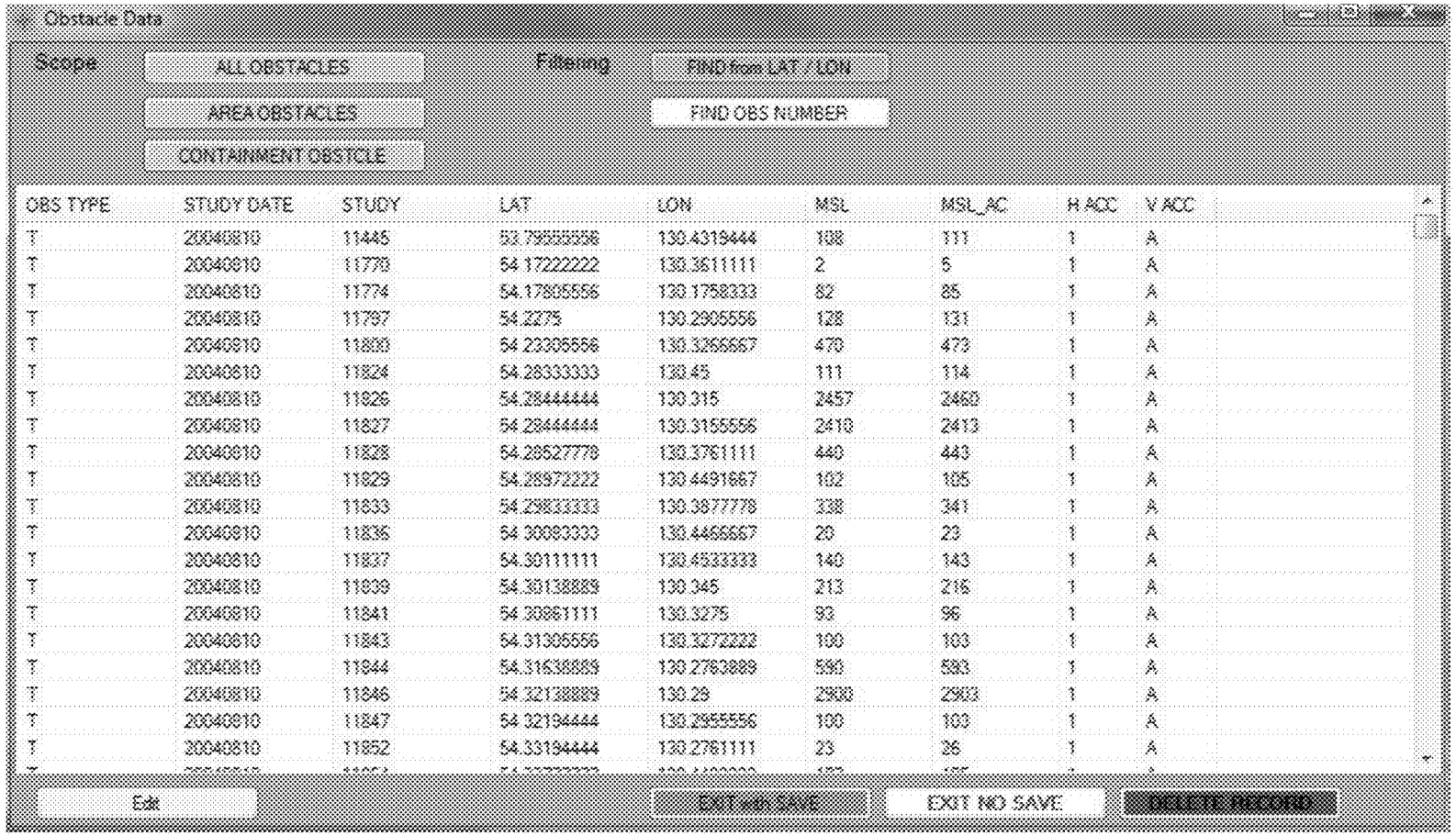
FIG. 13 is a representative user interface providing obstacle information from the obstacle database.
Figure 14:
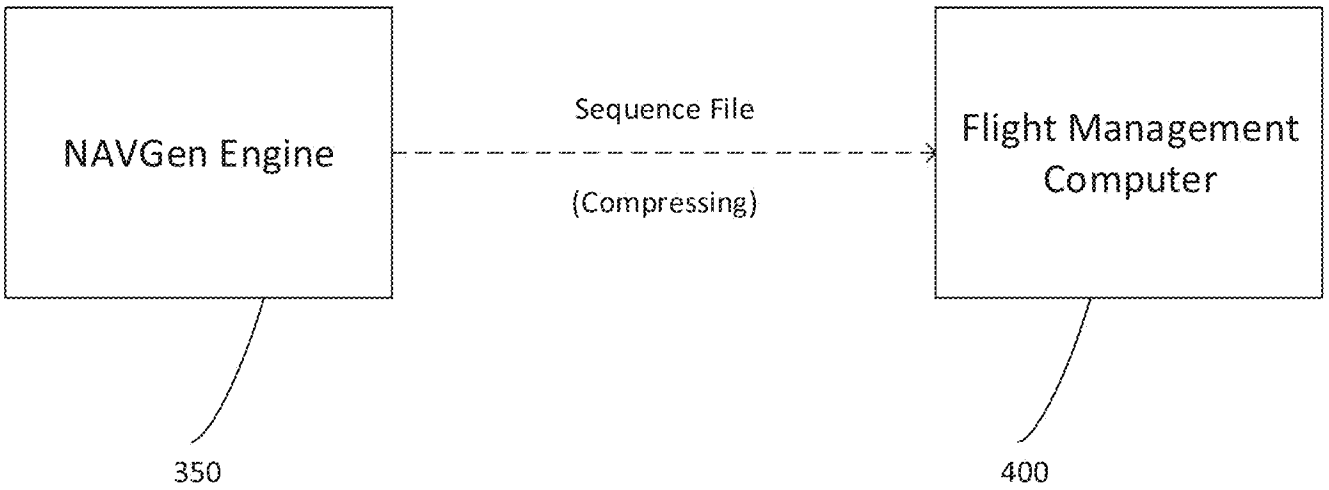
FIG. 14 is a diagram showing the flight path engine outputting a flight path, which is then compressed and uploaded, such as to a flight management computer for an aircraft that will be used to fly the flight path.

FIG. 13 is a user interface showing obstacle data from the obstacle database 374. The obstacle data includes the latitude and longitude coordinates for each obstacle each obstacle's altitude and a date on which the obstacle information was determined.

As described above, FIGS. 15 and 16 are additional depictions of a flight approach segment at different magnifications showing the obstacles in a final approach to a selected airport.

Figure 17:
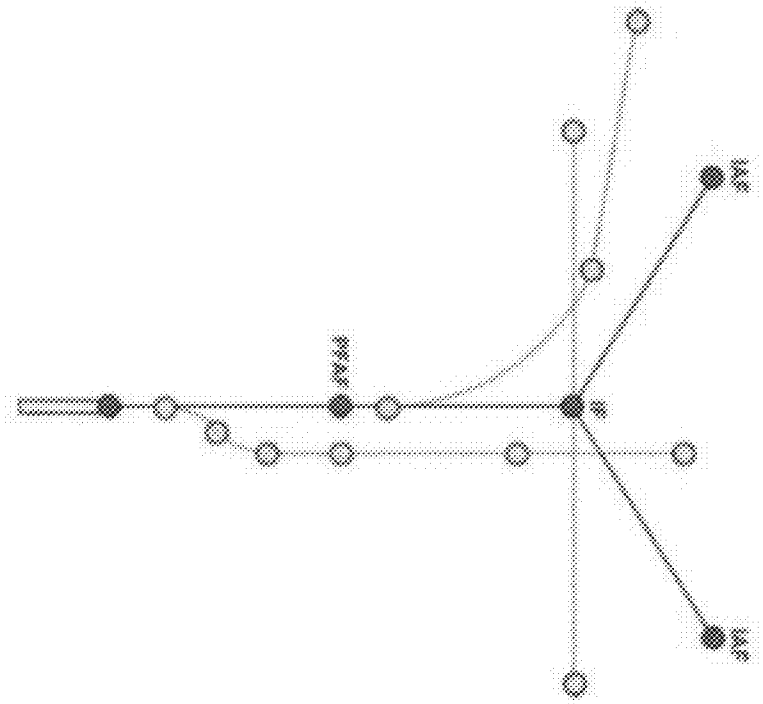
FIG. 17 is a tree structure diagram showing a flight path from a final approach fix.

FIG. 17 is a tree structure diagram showing a generalized flightpath as represented by several Initial Approach (IF) segments that merge into a common route of Intermediate Approach Fixes (IA) segments, Final Approach Fixes segments and then to a runway or a Missed Approach segment.

Figure 18:
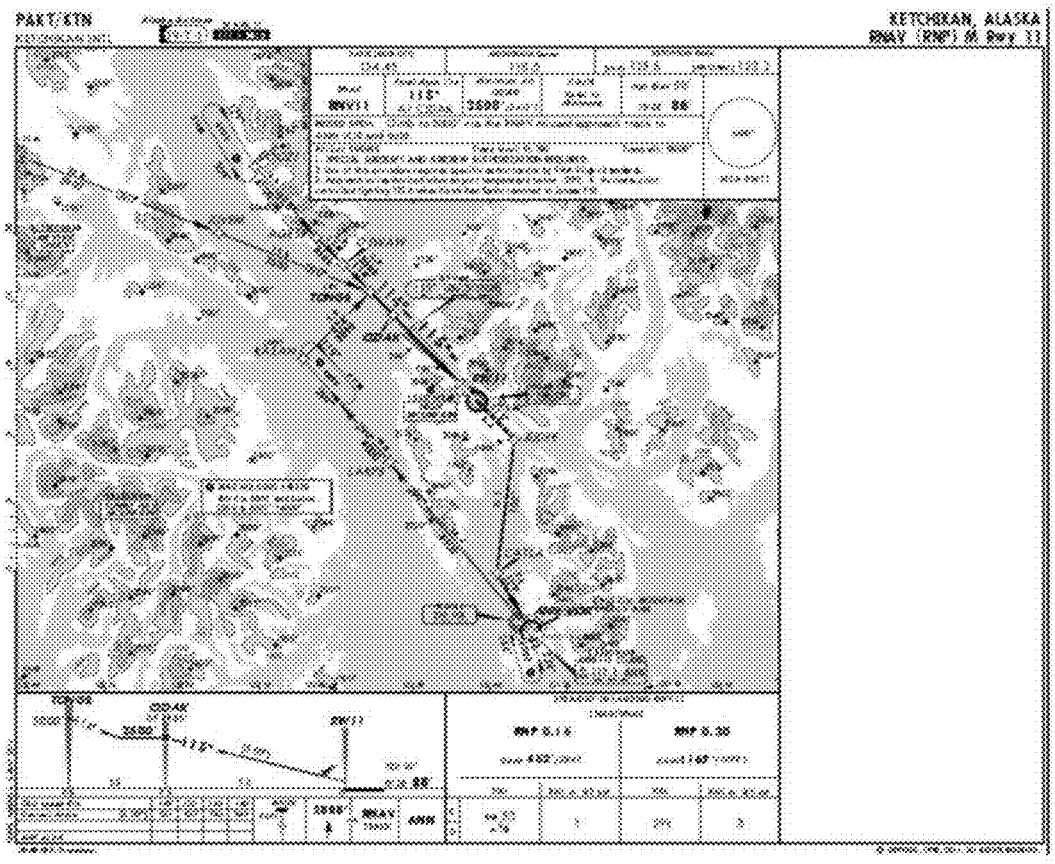
FIG. 18 is a map of a flight path to a selected airport showing RNP navigation information.

FIG. 18 is another graphical description of the PAKT airport at Ketchikan, Ak. showing a published flight path procedure. The contour markings show the mountainous surroundings. At the margins of the map, graphics showing the flight path parameters are given.

In addition to the design and evaluation of flight paths described above, the tools and techniques can also be used to assist in real-world verification of obstacles, such as during a physical inspection of a landing approach area. Among other advantages, the approaches described herein allow for real time measurement and verification of obstacle locations and heights.

Figure 22:
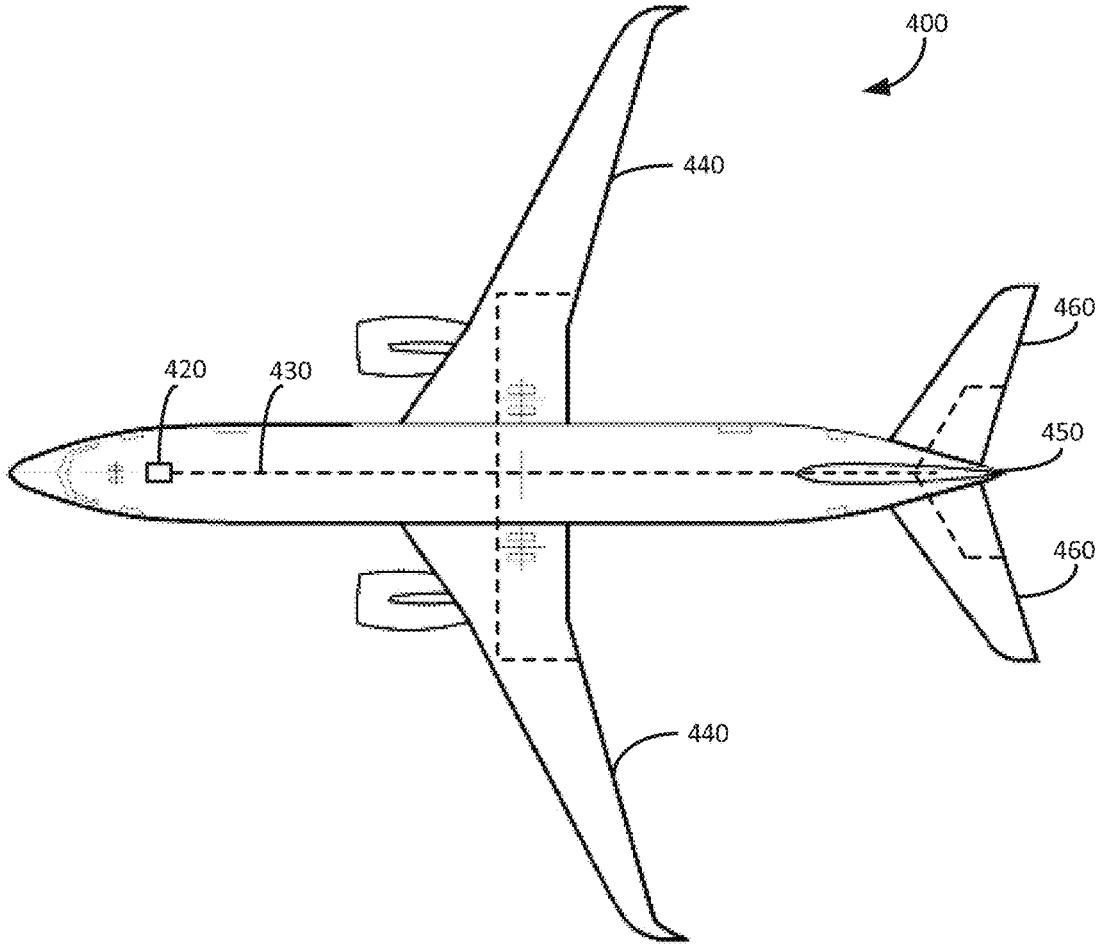
FIG. 22 is a schematic diagram of an aircraft having a navigation and control system that implements an approach procedure developed according to the described methods.

FIG. 22 is a schematic diagram of a representative aircraft 420 having a navigation and control system, shown generally at 420, in which at least one approach procedure or sequence file determined according to the methods described above has been uploaded. The navigation and control system 420 includes links 430 to various control surfaces 440, 450, 460 and other on-board systems for assistance in controlling the aircraft to follow the predetermined approach procedure. Because the approach procedure is determined as described above, it is an effective procedure that safely and efficiently leads to an objective while minimizing the duration and/or length of the flight, accounting for the aircraft's capabilities and operating within allowable guidelines.

Figure 2:
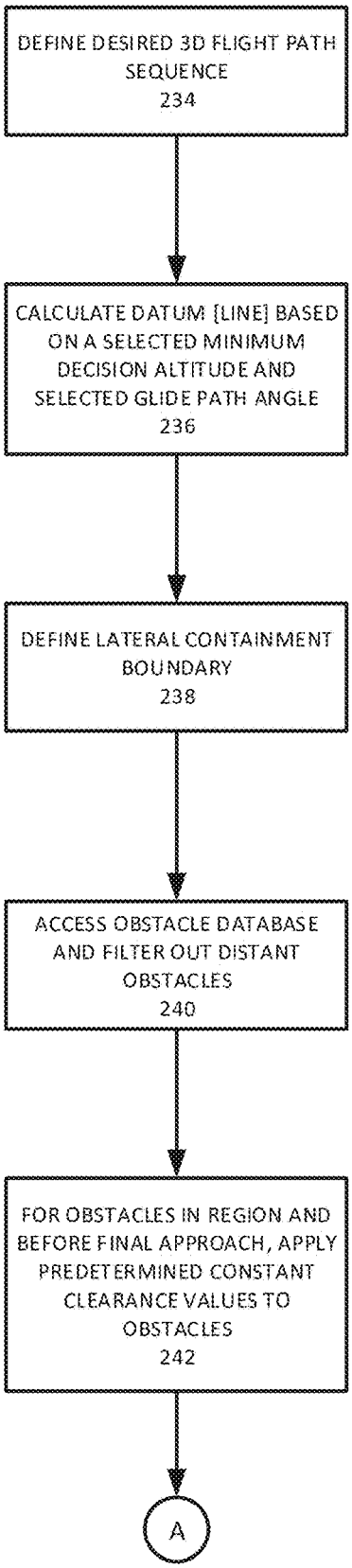
FIG. 2 is a process flow diagram of a representative method of determining a flight path for an aircraft.
Figure 2:
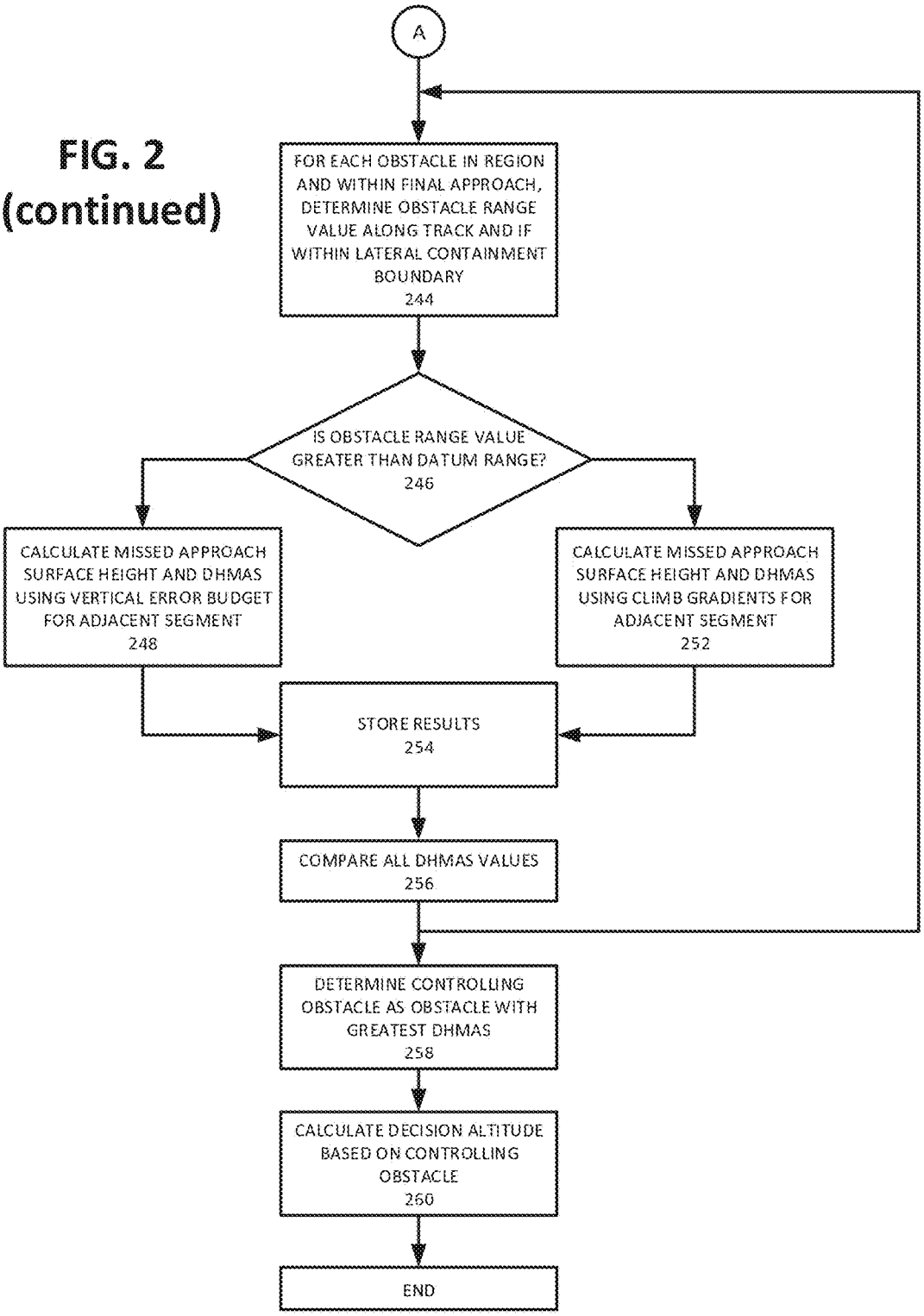

FIG. 2 is a process flow diagram showing steps of a representative method for determining a safe and efficient flight path. In step 232, a desired 3D flight path is defined. The 3D flight path can be comprised of waypoints each having a latitude, a longitude and an associated altitude constraint. In step 236, a datum is calculated based on a selected decision altitude and a selected glide path angle. In step 238, a lateral containment boundary is defined. In step 240, an obstacle database, such as the obstacle database 374, is accessed, and distant obstacles are filtered out. In step 242, for obstacles before final approach, predetermined required obstacle clearance (ROC) values are applied. In step 244, for each obstacle in region and within final approach, an obstacle range value along track is determined. In step 246, it is determined whether the obstacle range value is greater than the datum range. If so, then in step 250, the Missed Approach Surface height and DHMAS are calculated in step 248 using the vertical error budget for the adjacent segment, and the results are stored in step 254.

If the determination in step 246 is negative because the obstacle penetrates the VEB or MAS, then the Missed Approach Surface height and DHMAS are calculated in step 252 using climb gradient for the adjacent segment, and the results are stored in step 254.

In step 256, all DHMAS values are compared. In step 258, the controlling obstacle is determined as the obstacle having the greatest DHMAS value. In step 260, the decision altitude and the resultant DHMAS based on the controlling obstacle is calculated, and the procedure is updated.

Figure 19:
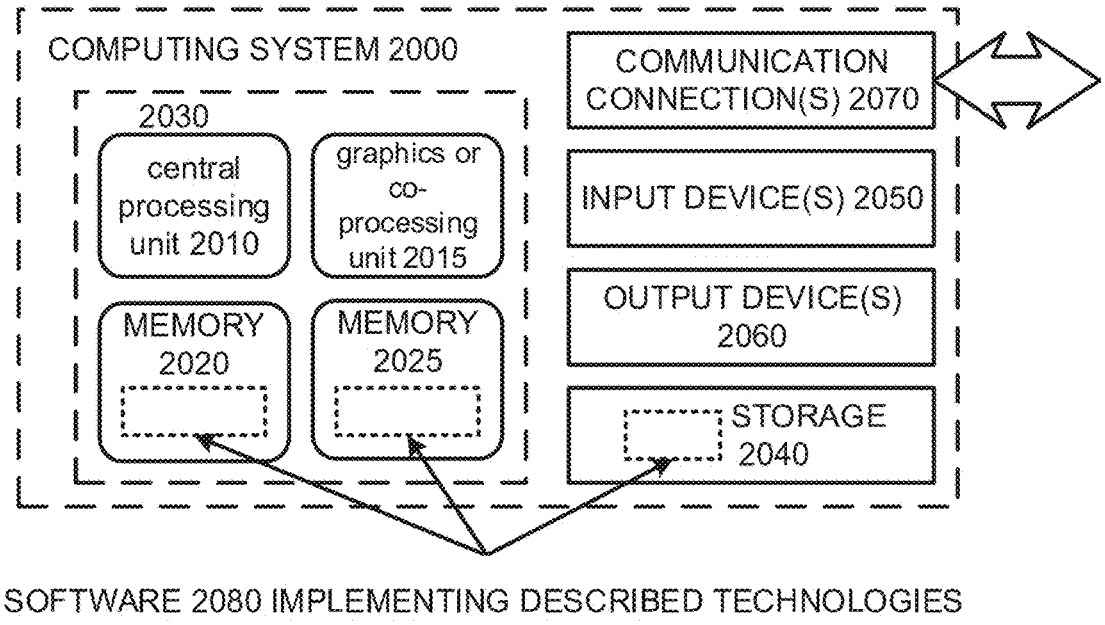
FIG. 19 is diagram illustrating an exemplary computing environment for a device implementing the disclosed technology.

FIG. 19 depicts a generalized example of a suitable computing system 2000 in which the described innovations may be implemented. The computing system 2000 is not intended to suggest any limitation as to scope of use or functionality, as the innovations may be implemented in diverse general-purpose or special-purpose computing systems.

The computing system 2000 includes one or more processing units 2010, 2015 and memory 2020, 2025. In FIG. 19, this basic configuration 2030 is included within a dashed line. The processing units 2010, 2015 execute computer-executable instructions. A processing unit can be a general-purpose central processing unit (CPU), processor in an application-specific integrated circuit (ASIC), or any other type of processor. In a multi-processing system, multiple processing units execute computer-executable instructions to increase processing power. For example, FIG. 19 shows a central processing unit 2010 as well as a graphics processing unit or co-processing unit 2015. The tangible memory 2020, 2025 may be volatile memory (e.g., registers, cache, RAM), non-volatile memory (e.g., ROM, EEPROM, flash memory, etc.), or some combination of the two, accessible by the processing unit(s). The memory 2020, 2025 stores software 2080 implementing one or more innovations described herein, in the form of computer-executable instructions suitable for execution by the processing unit(s).

A computing system may have additional features. For example, the computing system 2000 includes storage 2040, one or more input devices 2050, one or more output devices 2060, and/or one or more communication connections 2070. An interconnection mechanism (not shown) such as a bus, controller, or network interconnects the components of the computing system 2000. Typically, operating system software (not shown) provides an operating environment for other software executing in the computing system 2000, and coordinates activities of the components of the computing system 2000.

The tangible storage 2040 may be removable or non-removable, and includes magnetic disks, magnetic tapes or cassettes, CD-ROMs, DVDs, or any other medium which can be used to store information and which can be accessed within the computing system 2000. The storage 2040 stores instructions for the software 2080 implementing one or more innovations described herein.

The input device(s) 2050 may be a touch input device such as a keyboard, mouse, pen, or trackball, a voice input device, a scanning device, or another device that provides input to the computing system 2000. For video encoding, the input device(s) 2050 may be a camera (including OIS technology 2055), video card, TV tuner card, or similar device that accepts video input in analog or digital form, or a CD-ROM or CD-RW that reads video samples into the computing system 2000. The output device(s) 2060 may be a display, printer, speaker, CD-writer, and/or another devices that provide output from the computing system 2000.

The communication connection(s) 2070 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier.

The innovations can be described in the general context of computer-executable instructions, such as those included in program modules, being executed in a computing system on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing system.

Figure 20:
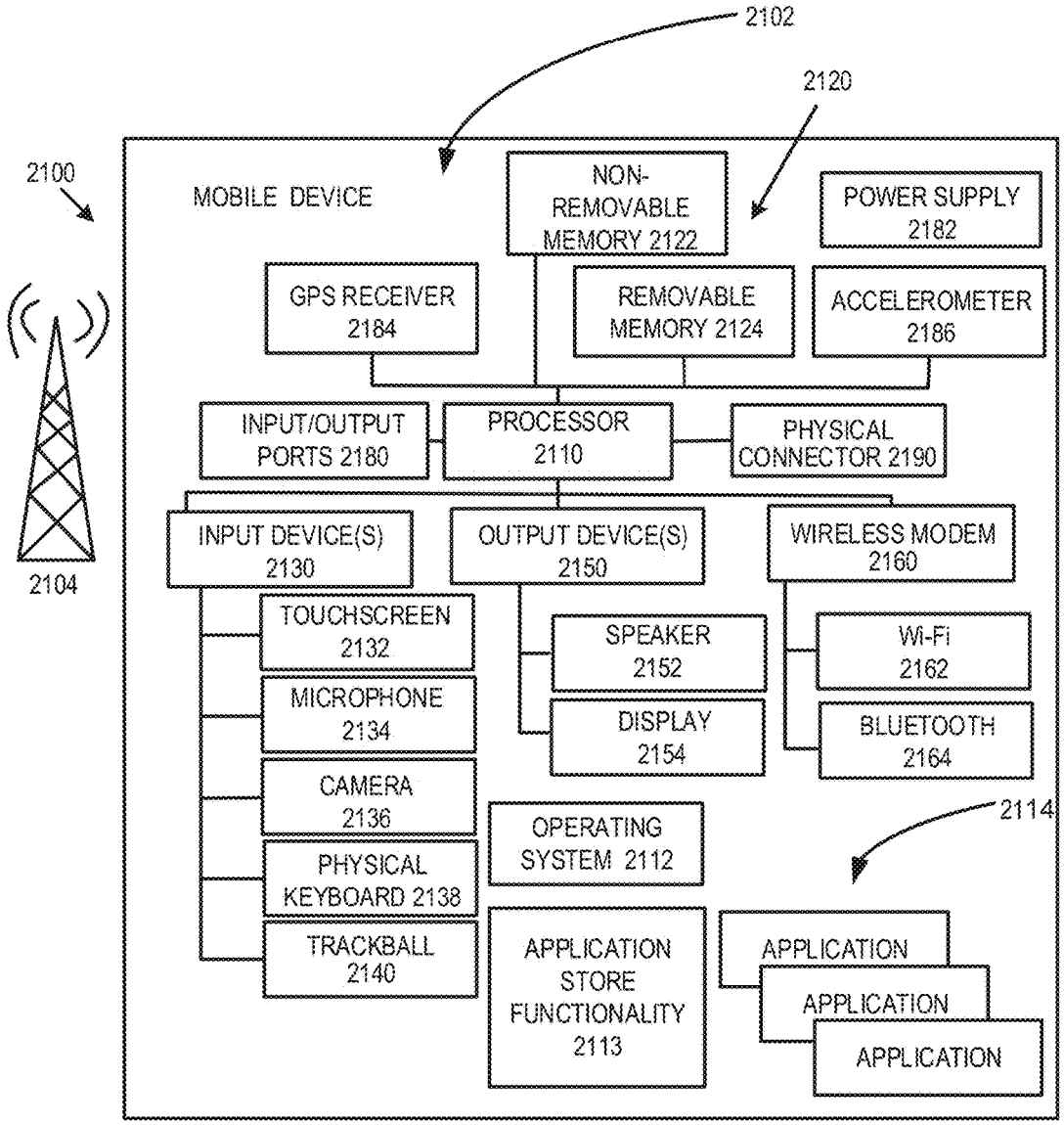
FIG. 20 is a schematic block diagram of an exemplary computing device implementing the disclosed technology.

FIG. 20 is a system diagram depicting another example of a computing device, such as a mobile electronic device 2100, in which the disclosed technology may be incorporated, including a variety of optional hardware and software components, shown generally at 2102. Any components 2102 in the mobile device can communicate with any other component, although not all connections are shown, for ease of illustration. The mobile device can be any of a variety of computing devices (e.g., cell phone, smartphone, handheld computer, Personal Digital Assistant (PDA), etc.) and can allow wireless two-way communications with one or more mobile communications networks 2104, such as a cellular, satellite, or other network.

The illustrated mobile device 2100 can include a controller or processor 2110 (e.g., signal processor, microprocessor, ASIC, or other control and processing logic circuitry) for performing such tasks as signal coding, data processing, input/output processing, power control, and/or other functions. An operating system 2112 can control the allocation and usage of the components 2102 and support for one or more application programs 2114. The application programs can include common mobile computing applications (e.g., email applications, calendars, contact managers, web browsers, messaging applications), or any other computing application, including software applications implementing one or more innovations described herein. Functionality 2113 for accessing an application store can also be used for acquiring and updating application programs 2114.

The illustrated mobile device 2100 can include memory 2120. Memory 2120 can include non-removable memory 2122 and/or removable memory 2124. The non-removable memory 2122 can include RAM, ROM, flash memory, a hard disk, or other well-known memory storage technologies. The removable memory 2124 can include flash memory or a Subscriber identity Module (SIM) card, which is well known in GSM communication systems, or other well-known memory storage technologies, such as "smart cards." The memory 2120 can be used for storing data and/or code for running the operating system 2112 and the applications 2114. Example data can include web pages, text, images, sound files, video data, or other data sets to be sent to and/or received from one or more network servers or other devices via one or more wired or wireless networks. The memory 2120 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The mobile device 2100 can support one or more input devices 2130, such as a touchscreen 2132, microphone 2134, camera 2136, physical keyboard 2138 and/or trackball 2140 and one or more output devices 2150, such as a speaker 2152 and a display(s) 2154. Other possible output devices (not shown) can include piezoelectric or other haptic output devices. Some devices can serve more than one input/output function. For example, a touchscreen 2132 and a display 2154 can be combined in a single input/output device.

The input devices 2130 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 2112 or applications 2114 can comprise speech-recognition software as part of a voice user interface that allows a user to operate the device 2100 via voice commands. Further, the device 2100 can comprise input devices and software that allows for user interaction via a user's spatial gestures, such as detecting and interpreting gestures to provide input to a gaming application. As stated, the described route engine implementations, as well as the other innovations described herein, can be one or more of the applications 2114.

A wireless modem 2160 can be coupled to an antenna (not shown) and can support two-way communications between the processor 2110 and external devices, as is well understood in the art. The modem 2160 is shown generically and can include a cellular modem for communicating with the mobile communication network 2104 and/or other radio-based modems (e.g., Bluetooth 2164 or WiFi 2162). The wireless modem 2160 is typically configured for communication with one or more cellular networks, such as a GSM network for data and voice communications within a single cellular network, between cellular networks, or between the mobile device and a public switched telephone network (PSTN).

The mobile device can further include at least one input/output port 2180, a power supply 2182, a satellite navigation system receiver 2184, such as a Global Positioning System (GPS) receiver, an accelerometer 2186, and/or a physical connector 2190, which can be a USB port, IEEE 1394 (FireWire) port, and/or RS-232 port. The illustrated components 2102 are not required or all-inclusive, as any components can be deleted and other components can be added.

Figure 21:
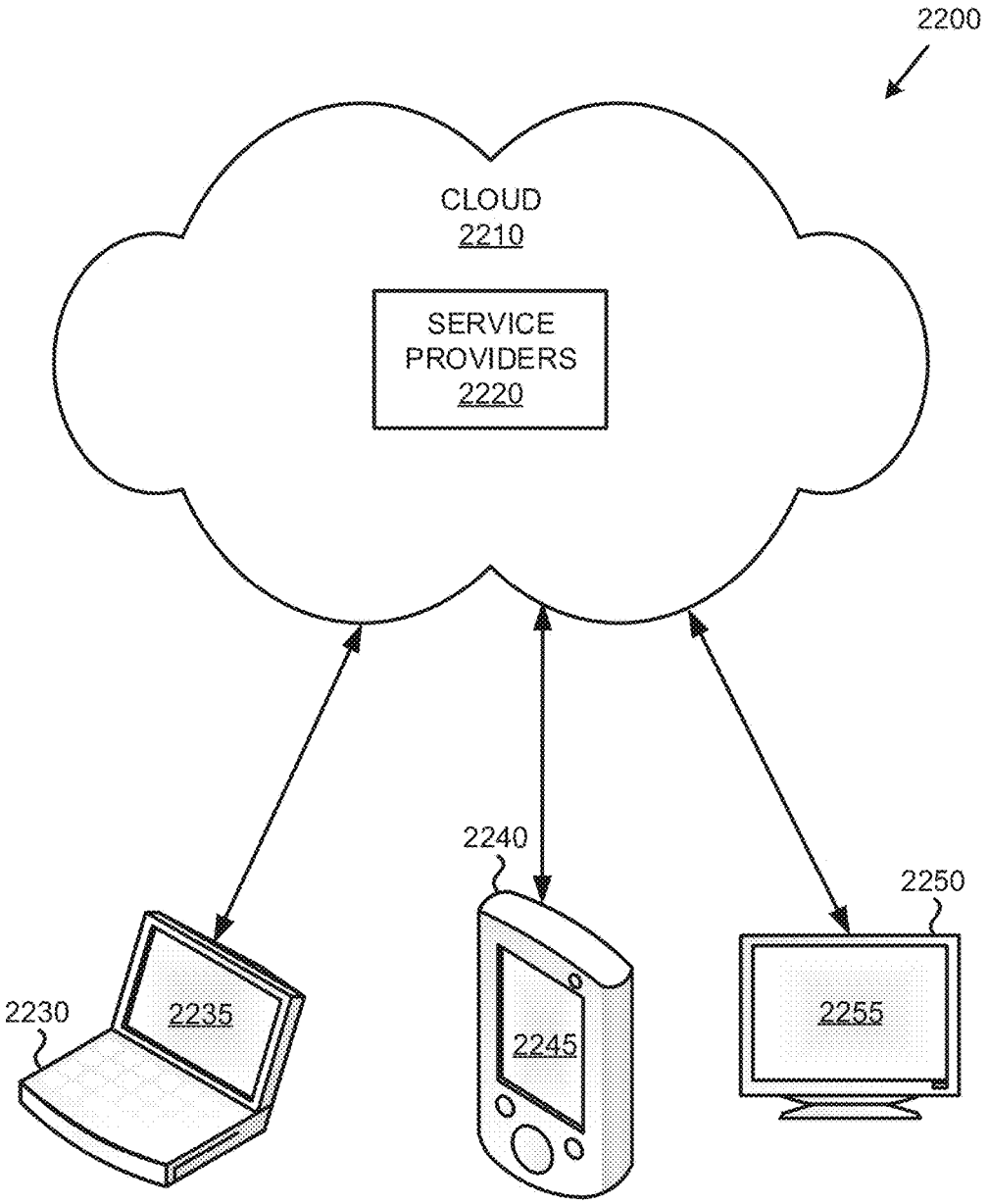
FIG. 21 is a diagram illustrating exemplary computing devices that can implement the disclosed technology, in an exemplary cloud-based communication and computing environment.

FIG. 21 illustrates a generalized example of a suitable cloud-supported environment 2200 in which described embodiments, techniques, and technologies may be implemented. In the example environment 2200, various types of services (e.g., computing services) are provided by a cloud 2210. For example, the cloud 2210 can comprise a collection of computing devices, which may be located centrally or distributed, that provide cloud-based services to various types of users and devices connected via a network such as the Internet. The implementation environment 2200 can be used in different ways to accomplish computing tasks. For example, some tasks (e.g., processing user input and presenting a user interface) can be performed on local computing devices (e.g., connected devices 2230, 2240, 2250) while other tasks (e.g., storage of data to be used in subsequent processing) can be performed in the cloud 2210. Devices 2230, 2240, and 2250 illustrate exemplary electronic devices in which the disclosed route engine technology can be implemented.

In example environment 2200, the cloud 2210 provides services for connected devices 2230, 2240, 2250 with a variety of screen capabilities. Connected device 2230 represents a device with a computer screen 2235 (e.g., a mid-size screen). For example, connected device 2230 could be a personal computer such as desktop computer, laptop, notebook, netbook, or the like. Connected device 2240 represents a device with a mobile device screen 2245 (e.g., a small size screen). For example, connected device 2240 could be a mobile phone, smart phone, handheld gaming controller, universal remote control, personal digital assistant, tablet computer, and the like. Connected device 2250 represents a device with a large screen 2255. For example, connected device 2250 could be a television screen (e.g., a smart television) or another device connected to a television (e.g., a set-top box or gaming console) or the like.

One or more of the connected devices 2230, 2240, 2250 can include touchscreen capabilities. Touchscreens can accept input in different ways. For example, capacitive touchscreens detect touch input when an object (e.g., a fingertip or stylus) distorts or interrupts an electrical current running across the surface. As another example, touchscreens can use optical sensors to detect touch input when beams from the optical sensors are interrupted. Physical contact with the surface of the screen is not necessary for input to be detected by some touchscreens. Devices without screen capabilities also can be used in example environment 2200. For example, the cloud 2210 can provide services for one or more computers (e.g., server computers) without displays.

Services can be provided by the cloud 2210 through service providers 2220, or through other providers of online services (not depicted). For example, cloud services can be customized to the screen size, display capability, and/or touchscreen capability of a particular connected device (e.g., connected devices 2230, 2240, 2250).

In example environment 2200, the cloud 2210 provides the technologies and solutions described herein to the various connected devices 2230, 2240, 2250 using, at least in part, the service providers 2220. For example, the service providers 2220 can provide a centralized solution for various cloud-based services. The service providers 2220 can manage service subscriptions for users and/or devices (e.g., for the connected devices 2230, 2240, 2250 and/or their respective users). The disclosed methods, apparatus, and systems should not be construed as limiting in any way. Instead, the present disclosure is directed toward all novel and nonobvious features and aspects of the various disclosed embodiments, alone and in various combinations and sub-combinations with one another. The disclosed methods, apparatus, and systems are not limited to any specific aspect or feature or combination thereof, nor do the disclosed embodiments require that any one or more specific advantages be present or problems be solved.

The terms "system" and "device" are used interchangeably herein. Unless the context clearly indicates otherwise, neither term implies any limitation on a type of computing system or computing device. In general, a computing system or device can include any combination of special-purpose hardware and/or general-purpose hardware with software implementing the functionality described herein.

For the sake of presentation, the detailed description uses terms like "determine" and "use" to describe computer operations in a computing system. These terms are high-level abstractions for operations performed by a computer, and should not be confused with acts performed by a human being. The actual computer operations corresponding to these terms vary depending on implementation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

In view of the many possible embodiments to which the principles of the disclosed technology may be applied, it should be recognized that the Illustrated embodiments are only preferred examples of the disclosed technology and should not be taken as limiting the scope of protection.

Rather, the scope of protection is defined by the following claims. I therefore claim all that comes within the scope of these claims.

I claim:

1. A method of controlling an aircraft in a runway approach at a selected runway, comprising:

using a flight management system to access a predetermined runway approach procedure for the runway approach, the runway approach procedure being determined by:

receiving a three dimensional flightpath to the runway, the flightpath comprising multiple data points, at least one straight segment and at least one curved segment;

determining a datum along the flightpath, the datum being based on an altitude for a selected glide path angle for the aircraft and having a datum range defined as a distance from the datum to the runway;

defining a lateral containment boundary for the flightpath;

for obstacles along the flightpath and within the lateral containment boundary, assigning respective obstacle range values, wherein an obstacle range value for a selected obstacle is equal to a distance of the selected obstacle from the runway;

for obstacles in a final approach segment of the flightpath and having obstacle range values greater than the datum range, calculating a missed approach surface height at a projected intersection of a missed approach surface with a descending vertical error budget surface and a corresponding Distance to Height of Missed Approach Surface from the runway (DHMAS);

for obstacles in the final approach segment of the flightpath and having obstacle range values less than the datum range, calculating a missed approach surface height and a corresponding DHMAS using ascending climb gradient requirements; comparing DHMAS values and determining a controlling obstacle having a greatest DHMAS; and calculating a decision altitude for the controlling obstacle and updating the runway approach procedure with the decision altitude;

displaying the runway approach procedure graphically and indicating the decision altitude;

calculating a current position of the aircraft and updating the displayed runway approach procedure to indicate the current aircraft position;

receiving current environmental conditions data at the runway comprising at least one of current barometric pressure and current temperature; and verifying that the decision altitude applies for the current environmental conditions at the runway.

2. The method of claim 1, further comprising calculating data for obstacles in the lateral containment boundary other than the controlling obstacle and storing the data in the form of metadata relative to the controlling obstacle.

3. The method of claim 1, further comprising, for obstacles having obstacle range values greater than a range of a starting point of the final approach segment, assigning respective predetermined obstacle clearance values.

4. The method of claim 1, wherein determining the datum along the flightpath comprises setting the datum based on a selected minimum decision altitude.

5. The method of claim 1, wherein calculating the missed approach surface height for an obstacle in the final approach segment of the flightpath is based in part on calculating a nonlinear equation representing a curved vertical error budget surface extending from a final approach fix to the datum.

6. The method of claim 1, wherein the lateral containment boundary is defined to contain at least one of obstacles in RF turns based on a lateral arcing containment around a radius fix or obstacles near fly-by turns based on turn performance parameters.

7. The method of claim 1, wherein for obstacles in the final approach segment of the flightpath and having obstacle range values range less than the datum range, calculating a missed approach surface height and a corresponding DHMAS using climb gradient requirements at the projected intersection of a descending vertical error budget surface and a missed approach surface.

8. The method of claim 1, wherein for obstacles in the final approach segment of the flightpath and having obstacle range values greater than the datum range, calculating DHMAS comprises solving DHMAS=X+obstacle range value, where X is a distance between the obstacle and the projected intersection.

9. The method of claim 1, wherein calculating the decision altitude comprises adding a predetermined constant selected to account for round-off error.

10. The method of claim 1, wherein a start of climb inflection point is defined along a vertical line at the datum at a height of the actual vertical error budget surface at the datum plus a predetermined constant.

11. The method of claim 10, wherein the start of climb inflection point is based in part on a threshold crossing height constant defined for an end of the runway.

12. The method of claim 1, wherein the multiple data points comprise waypoints having a longitude, a latitude and an associated altitude constraint.

13. The method of claim 1, wherein a minimum start of climb altitude is defined at the datum.

14. The method of claim 1, wherein the descending vertical error budget surface is nonlinear.

15. The method of claim 1, further comprising updating a database with data describing a distance by which a controlling obstacle exceeds precedence of other obstacles.

16. The method of claim 1, further comprising displaying an indication if the decision altitude does not apply in the current environmental conditions.

17. A flight management system, comprising:

at least one processor;

memory linked to the at least one processor and having stored instructions for causing the processor to perform a plurality of operations, including:

accessing a predetermined runway approach procedure stored in the memory for the runway approach, the runway approach procedure being determined by a flight path engine and comprising:

receiving three-dimensional flightpath data describing a flightpath, the flightpath comprising multiple data points, at least one straight segment and at least one curved segment;

determining a datum along the flightpath, the datum being based on an altitude for a selected glide path angle for the aircraft and having a datum range defined as a distance from the datum to the runway;

defining a lateral containment boundary for the flightpath;

for obstacles along the flightpath and within the lateral containment boundary, assigning respective obstacle range values, wherein an obstacle range value for a selected obstacle is equal to a distance of the selected obstacle from the runway;

for obstacles in a final approach segment of the flightpath and having obstacle range values greater than the datum range, calculating a missed approach surface height at a projected intersection of a missed approach surface with a descending vertical error budget surface and a corresponding Distance to Height of Missed Approach Surface from the runway (DHMAS);

for obstacles in the final approach segment of the flightpath and having obstacle range values less than the datum range, calculating a missed approach surface height and a corresponding DHMAS using ascending climb gradient requirements;

comparing DHMAS values and determining a controlling obstacle having a greatest DHMAS; and calculating a decision altitude for the controlling obstacle and updating the runway approach procedure with the decision altitude displaying the runway approach procedure graphically and indicating the decision altitude;

calculating a current position of the aircraft and updating the displayed runway approach procedure to indicate the current aircraft position;

receiving current environmental conditions data at the runway comprising at least one of current barometric pressure and current temperature; and verifying that the decision altitude applies for the current environmental conditions at the runway.

18. The flight management system of claim 16, wherein the plurality of operations carried out by the processor comprises displaying an indication if the decision altitude does not apply in the current environmental conditions.

* * * * *